US008991809B2

(12) United States Patent
Tanonaka

(10) Patent No.: US 8,991,809 B2
(45) Date of Patent: Mar. 31, 2015

(54) POST-PROCESSING APPARATUS AND IMAGE FORMING APPARATUS

(71) Applicant: KYOCERA Document Solutions Inc., Osaka-shi, Osaka (JP)

(72) Inventor: Atsushi Tanonaka, Osaka (JP)

(73) Assignee: KYOCERA Document Solutions Inc, Osaka-shi (JP)

( * ) Notice: Subject to any disclaimer, the term of this patent is extended or adjusted under 35 U.S.C. 154(b) by 0 days.

(21) Appl. No.: 14/108,013

(22) Filed: Dec. 16, 2013

(65) Prior Publication Data

US 2014/0175729 A1 Jun. 26, 2014

(30) Foreign Application Priority Data

Dec. 26, 2012 (JP) ..... 2012-282156

(51) Int. Cl.

| | |
|---|---|
| ***B42C 1/12*** | (2006.01) |
| ***B65H 39/06*** | (2006.01) |
| ***B65H 37/04*** | (2006.01) |
| ***B31F 5/00*** | (2006.01) |
| ***B65H 39/10*** | (2006.01) |

(52) U.S. Cl.

CPC *B42C 1/12* (2013.01); *B65H 39/06* (2013.01); *B65H 37/04* (2013.01); *B65H 2801/27* (2013.01); *B31F 5/001* (2013.01); *B65H 39/10* (2013.01); *B65H 2407/21* (2013.01); *B65H 2511/414* (2013.01); *B65H 2511/514* (2013.01); *B65H 2551/10* (2013.01)

USPC ..... 270/58.09; 270/58.08

(58) Field of Classification Search

CPC ..... B65H 37/04; B65H 2801/27; B42C 1/12; B42C 1/125; B31F 5/001

USPC ..... 270/58.07, 58.08, 58.09, 52.18; 399/408, 410

See application file for complete search history.

(56) References Cited

U.S. PATENT DOCUMENTS

| | | | | |
|---|---|---|---|---|
| 4,878,656 | A * | 11/1989 | Honjo et al. | 270/58.09 |
| 8,028,984 | B2 * | 10/2011 | Taki et al. | 270/58.09 |
| 8,382,090 | B2 * | 2/2013 | Sasamoto et al. | 270/58.07 |
| 2011/0033218 | A1 * | 2/2011 | Sasahara | 399/410 |

FOREIGN PATENT DOCUMENTS

JP 2005206298 A 8/2005

* cited by examiner

*Primary Examiner* — Leslie A Nicholson, III

(74) *Attorney, Agent, or Firm* — Alleman Hall McCoy Russell & Tuttle LLP

(57) ABSTRACT

A post-processing apparatus includes a processing tray, a conveyance portion, a staple unit, an operation portion, a mode switching portion, a cover, and an open/close detection portion. The staple unit, which has an automatic mode and a manual mode as processing modes for stapling processing, executes stapling processing for a paper sheet conveyed to the processing tray by the conveyance portion in the automatic mode, and executes stapling processing for a paper sheet stacked on the processing tray by a user in the manual mode. The cover is attached in an openable and closable manner so as to cover the operation portion when closed, and expose the operation portion when opened. While the open/close detection portion is detecting that the cover is opened, when the operation portion has received an operation for switching to the manual mode, the mode switching portion switches the automatic mode to the manual mode.

8 Claims, 6 Drawing Sheets

POST-PROCESSING APPARATUS AND IMAGE FORMING APPARATUS

INCORPORATION BY REFERENCE

This application is based upon and claims the benefit of priority from the corresponding Japanese Patent Application No. 2012-282156 filed on Dec. 26, 2012, the entire contents of which are incorporated herein by reference.

BACKGROUND

The present disclosure relates to a post-processing apparatus and an image forming apparatus.

Conventionally, a post-processing apparatus is known which executes various types of post-processing such as stapling processing for a printed paper sheet outputted from an image forming apparatus.

Such a post-processing apparatus capable of executing stapling processing at least includes, for example, a staple unit, and a processing tray for stacking paper sheets to be processed by stapling processing. Upon execution of the stapling processing, the post-processing apparatus receives printed paper sheets outputted from the image forming apparatus one by one, to convey them to the processing tray, so that the printed paper sheets are stacked on the processing tray. Thereafter, the staple unit performs stapling processing for a plurality of paper sheets (sheet bundle) stacked on the processing tray.

In addition, conventionally, also known is a post-processing apparatus having an automatic mode for executing stapling processing for paper sheets fed from the image forming apparatus, and a manual mode for executing stapling processing for paper sheets manually fed onto the processing tray by a user.

SUMMARY

A post-processing apparatus according to one aspect of the present disclosure includes a processing tray, a conveyance portion, a staple unit, an operation portion, a mode switching portion, a cover, and an open/close detection portion. On the processing tray, a paper sheet to be processed by stapling processing can be stacked. The conveyance portion conveys a paper sheet to the processing tray. The staple unit has an automatic mode and a manual mode as processing modes for the stapling processing. In the automatic mode, the staple unit executes the stapling processing for a paper sheet conveyed to the processing tray by the conveyance portion. In the manual mode, the staple unit executes the stapling processing for a paper sheet stacked on the processing tray by a user. The operation portion receives an operation for switching between the automatic mode and the manual mode. The mode switching portion performs switching between the automatic mode and the manual mode in response to an operation on the operation portion. The cover is attached in an openable and closable manner so as to cover the operation portion when the cover is closed and expose the operation portion when the cover is opened. The open/close detection portion detects whether the cover is opened or closed. While the open/close detection portion is detecting that the cover is opened, when the operation portion has received an operation for switching to the manual mode, the mode switching portion switches the automatic mode to the manual mode.

An image forming apparatus according to another aspect of the present disclosure includes a post-processing apparatus and a printing portion. The printing portion executes a print job and feeds a printed paper sheet to the post-processing apparatus. The post-processing apparatus includes a processing tray, a conveyance portion, a staple unit, an operation portion, a mode switching portion, a cover, and an open/close detection portion. On the processing tray, a paper sheet to be processed by stapling processing can be stacked. The conveyance portion conveys a paper sheet to the processing tray. The staple unit has an automatic mode and a manual mode as processing modes for the stapling processing. In the automatic mode, the staple unit executes the stapling processing for a paper sheet conveyed to the processing tray by the conveyance portion. In the manual mode, the staple unit executes the stapling processing for a paper sheet stacked on the processing tray by a user. The operation portion receives an operation for switching between the automatic mode and the manual mode. The mode switching portion performs switching between the automatic mode and the manual mode in response to an operation on the operation portion. The cover is attached in an openable and closable manner so as to cover the operation portion when the cover is closed and expose the operation portion when the cover is opened. The open/close detection portion detects whether the cover is opened or closed. While the open/close detection portion is detecting that the cover is opened, when the operation portion has received an operation for switching to the manual mode, the mode switching portion switches the automatic mode to the manual mode.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an image forming apparatus provided with a post-processing apparatus according to one embodiment of the present disclosure will be described, using an image forming apparatus (multifunction peripheral) capable of executing plural kinds of jobs, as an example.

(Configuration of Image Forming Apparatus Provided with Post-Processing Apparatus)

Figure 1:
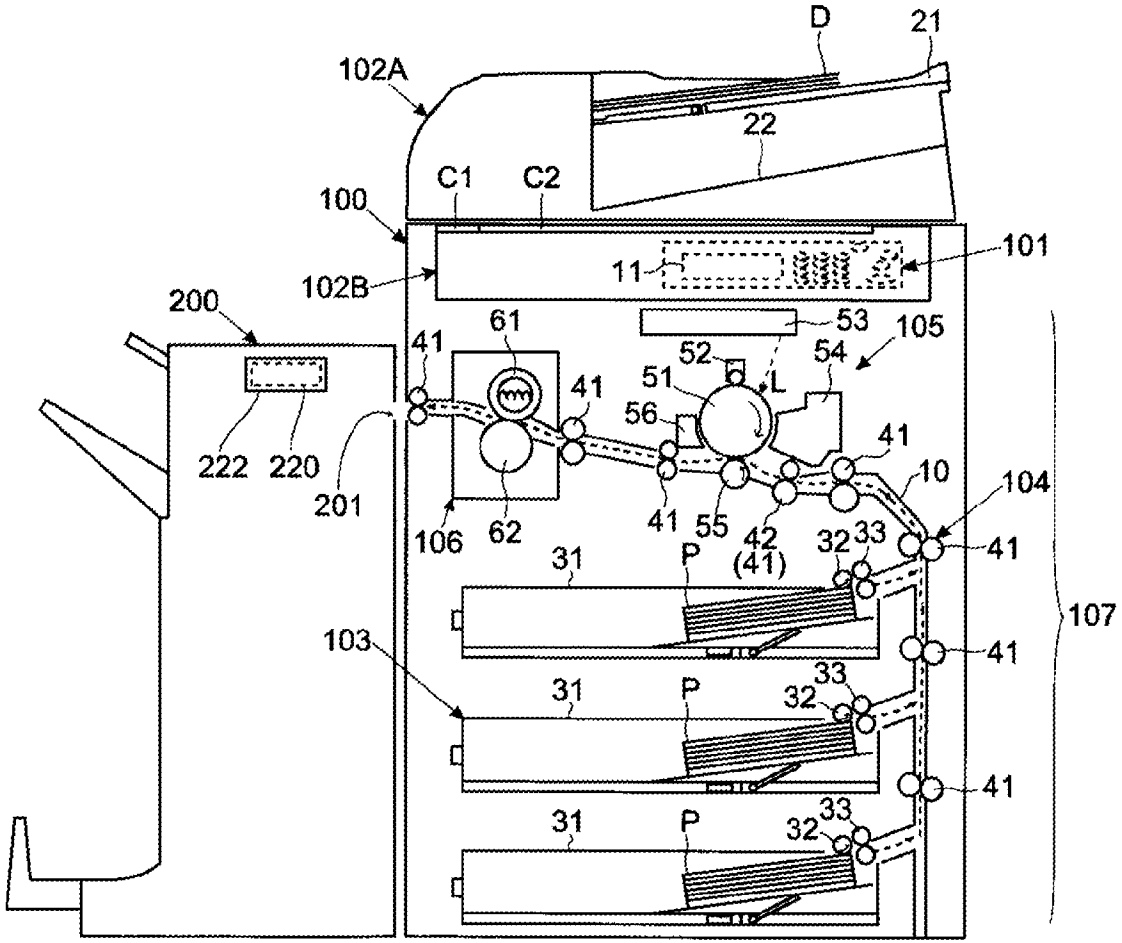
FIG. 1 is a diagram of an image forming apparatus provided with a post-processing apparatus according to one embodiment of the present disclosure.

As shown in FIG. 1, an image forming apparatus 100 of the present embodiment includes an operation panel 101, a document sheet conveying portion 102A, an image reading portion 102B, a sheet feed portion 103, a paper sheet conveyance portion 104, an image forming portion 105, and a fixing portion 106. Among these portions, each of the sheet feed portion 103, the paper sheet conveyance portion 104, the image forming portion 105, and the fixing portion 106 is a mechanism portion needed for executing a job (print job) accompanied with printing, and correspond to a "printing portion" of the present disclosure. Hereinafter, the mechanism portion needed for executing a print job may be referred to as a printing portion 107.

The operation panel 101 includes a liquid crystal display portion 11 with a touch panel. The liquid crystal display portion 11 displays software keys and/or menus for receiving various settings. In addition, the operation panel 101 is provided with a numeric keypad for receiving numeric input, and/or a hardware key such as a start key for receiving an instruction to execute various jobs.

The document sheet conveying portion 102A is attached in an openable and closable manner to the image reading portion 102B around a rotational axis (not shown) as a fulcrum provided on the apparatus back surface side of the image reading portion 102B. The document sheet conveying portion 102A pulls out a document sheet D set on a document sheet set tray 21, feeds the document sheet D to above a conveyance reading contact glass C1, and discharges the document sheet D to a document sheet discharge tray 22. In addition, the document sheet conveying portion 102A also functions to hold a document sheet D placed on a placement reading contact glass C2.

The image reading portion 102B scans a document sheet D to generate image data of an image of the document sheet D. The image reading portion 102B includes optical members such as an exposure lamp, a mirror, a lens, and an image sensor (they are not shown). The image reading portion 102B radiates light onto a document sheet D passing above the conveyance reading contact glass C1 or a document sheet D placed on the placement reading contact glass C2. Then, the image reading portion 102B performs A/D conversion for an output value of the image sensor receiving a reflected light from the document sheet D, thereby generating image data of an image of the document sheet D.

The sheet feed portion 103 includes cassettes 31 for accommodating paper sheets P, and feeds a paper sheet P in each cassette 31 to a main body conveyance path 10. The sheet feed portion 103 is provided with a pickup roller 32 for pulling out a paper sheet P in each cassette 31. In addition, the sheet feed portion 103 is provided with a sheet feed roller pair 33 for preventing multi feed of paper sheets P taken out from each cassette 31 while feeding a paper sheet P to the main body conveyance path 10.

The paper sheet conveyance portion 104 conveys a paper sheet P fed to the main body conveyance path 10, along the main body conveyance path 10, and guides the paper sheet P through the image forming portion 105 and the fixing portion 106 to a carry in port 201 of a post processing apparatus 200 described later. The paper sheet conveyance portion 104 includes a plurality of conveying roller pairs 41 rotatably provided on the main body conveyance path 10. One pair of the plurality of conveying roller pairs 41 is a registration roller pair 42 which causes a paper sheet P to stand by before the image forming portion 105 and feeds the paper sheet P to the image forming portion 105 in accordance with a timing of formation of an electrostatic latent image in the image forming portion 105.

The image forming portion 105 forms a toner image based on image data of an image to be printed, and transfers the toner image onto a paper sheet P. The image forming portion 105 includes a photosensitive drum 51, a charging device 52, an exposure device 53, a developing device 54, a transfer roller 55, and a cleaning device 56.

Upon image forming, the photosensitive drum 51 is rotationally driven while the charging device 52 charges the surface of the photosensitive drum 51 at a predetermined potential. The exposure device 53 includes a light emitting device (not shown) which outputs a light beam L for exposure, and turns on and off the light emitting device to scan and expose the surface of the photosensitive drum 51 to light. Thus, an electrostatic latent image is formed on the surface of the photosensitive drum 51. The developing device 54 supplies toner onto the electrostatic latent image formed on the surface of the photosensitive drum 51, thereby developing the image.

The transfer roller 55 can be rotated while being pressed against the surface of the photosensitive drum 51. At an appropriate timing, the registration roller pair 42 causes a paper sheet P to enter between the transfer roller 55 and the photosensitive drum 51. Thus, a toner image formed on the surface of the photosensitive drum 51 is transferred onto the paper sheet P. Thereafter, the cleaning device 56 removes residual toner and the like on the surface of the photosensitive drum 51.

The fixing portion 106 heats and pressurizes the toner image transferred on the paper sheet P, to fix the toner image. The fixing portion 106 includes a fixing roller 61 including a heat source, and a pressure roller 62 to be pressed against the fixing roller 61. A paper sheet P having a toner image transferred thereon passes between the fixing roller 61 and the pressure roller 62, and thereby is heated and pressurized. Thus, the toner image is fixed on the paper sheet P, whereby printing is completed.

The image forming apparatus 100 is provided with the post-processing apparatus 200 which performs post-processing for a printed paper sheet P. The post-processing apparatus 200 has the carry-in port 201 to be connected to the main body conveyance path 10, and receives a printed paper sheet P fed via the carry-in port 201. The post-processing apparatus 200 performs, for example, punching processing, stapling processing, and folding processing for a printed paper sheet P.

(Configuration of Post-Processing Apparatus)

Figure 2:
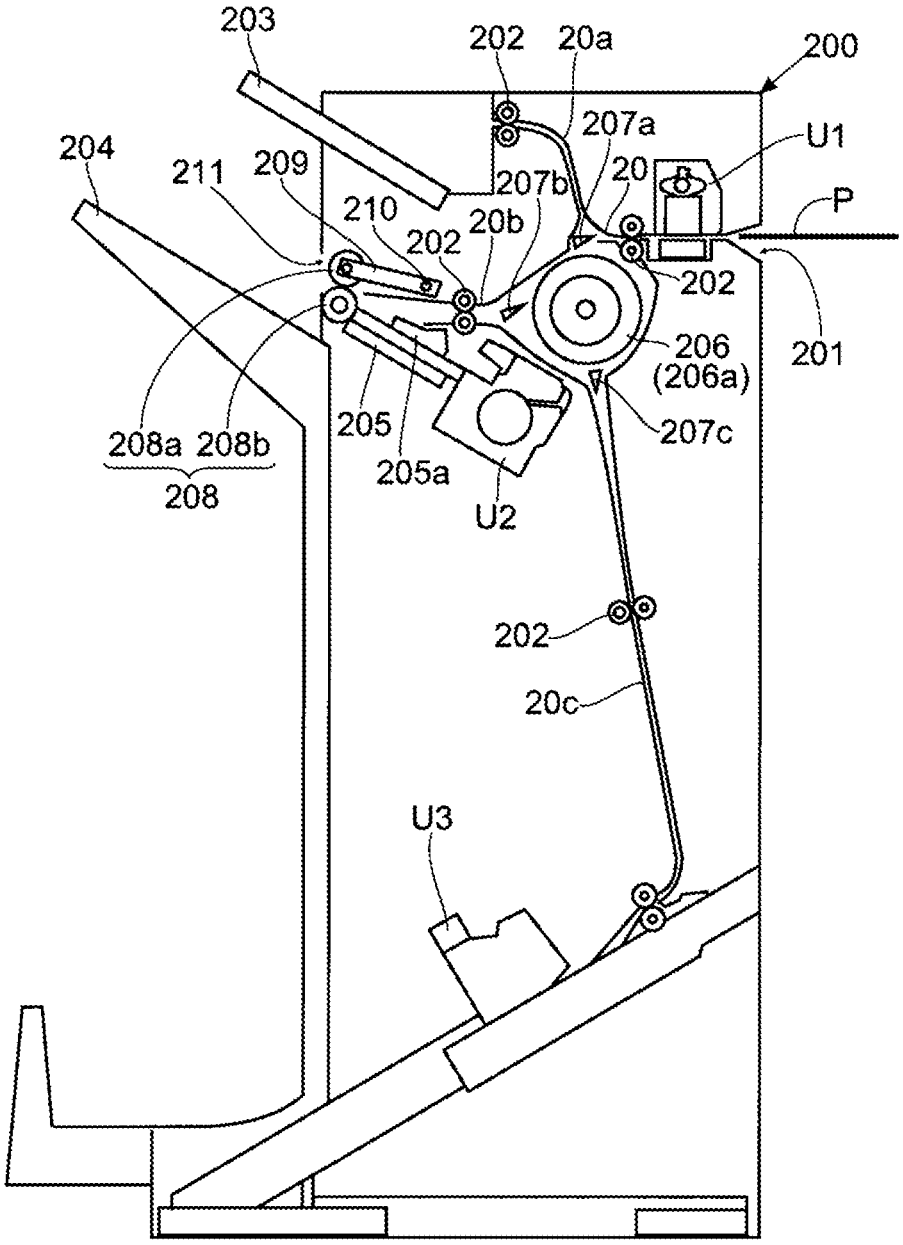
FIG. 2 is a diagram of the post-processing apparatus shown in FIG. 1.

As shown in FIG. 2, the post-processing apparatus 200 conveys a paper sheet P carried in from the carry-in port 201, along a post-processing conveyance path 20, and performs post-processing for the paper sheet P. Therefore, the post-processing apparatus 200 is provided with a plurality of conveying roller pairs 202 for conveying a paper sheet P. It is noted that the conveying roller pairs 202 correspond to a "conveyance portion" of the present disclosure.

The post-processing apparatus 200 includes a punch unit U1, a staple unit U2, a booklet unit U3, and the like. The punch unit U1 performs punching processing for a paper sheet P. The staple unit U2 performs stapling processing for a paper sheet P. The booklet unit U3 performs folding processing for a paper sheet P.

The punch unit U1 is located upstream (near the carry-in port 201) of the post-processing conveyance path 20 in the conveyance direction of a paper sheet P. The post-processing conveyance path 20 branches into three conveyance paths 20*a*, 20*b*, and 20*c* on the downstream of the punch unit U1 in the conveyance direction of a paper sheet P.

The conveyance path 20*a* leads to a sheet discharge tray 203. When stapling processing and/or folding processing are not performed, a paper sheet P having passed through the punch unit U1 is discharged to the sheet discharge tray 203 via the conveyance path 20*a*.

The conveyance path 20*b* leads to another sheet discharge tray 204 different from the sheet discharge tray 203. A processing tray 205 is provided on a conveyance route defined by the conveyance path 20*b* (specifically, immediately before the sheet discharge tray 204). When stapling processing is performed, a paper sheet P is conveyed to the processing tray 205 via the conveyance path 20*b*, so that a plurality of paper sheets P are stacked on the placement surface of the processing tray 205. It is noted that stapling processing is performed for a bundle of a plurality of paper sheets P (hereinafter, may be simply referred to as a sheet bundle) stacked on the placement surface of the processing tray 205.

The conveyance path 20*c* leads to the booklet unit U3. When folding processing is performed, a paper sheet P is conveyed to the booklet unit U3 via the conveyance path 20*c*.

A refuge portion 206 for temporarily evacuating a paper sheet P conveyed from the punch unit U1 is provided at a portion where the post-processing conveyance path 20 branches. At the refuge portion 206, a paper sheet P is wound on a refuge drum 206*a* which is rotationally driven, whereby the paper sheet P is evacuated (conveyance of the paper sheet P to the processing tray 205 is delayed).

A plurality of switching claws 207*a*, 207*b*, and 207*c* for switching the conveyance path of a paper sheet P are provided at a portion where the post-processing conveyance path 20 branches (around the refuge drum 206). When stapling processing and/or folding processing are not performed, the switching claw 207*a* is turned in a direction to open an entrance port of the conveyance path 20*a*. Thus, a paper sheet P having passed through the punch unit U1 enters the conveyance path 20*a*, to be conveyed to the sheet discharge tray 203.

When stapling processing is performed, the switching claw 207*a* is turned in a direction to close the entrance port of the conveyance path 20*a*. At this time, if evacuation of a paper sheet P is not needed, the switching claw 207*b* is turned in a direction to open an entrance port of the conveyance path 20*b*. Thus, the paper sheet P enters the conveyance path 20*b*, to be guided to the processing tray 205. On the other hand, if evacuation of a paper sheet P is needed, the switching claw 207*b* is turned in a direction to close the entrance port of the conveyance path 20*b*. Thus, the paper sheet P enters the refuge portion 206 without entering the conveyance path 20*b*.

Here, the processing tray 205 is disposed so as to be inclined obliquely downward from its one end (sheet discharge tray 204 side) toward the other end. A discharge roller pair 208 (upper roller 208*a* and lower roller 208*b*) for discharging a paper sheet P to the sheet discharge tray 204 is provided at the one end of the processing tray 205. One end of an arm 209 is connected with the upper roller 208*a*, and a rotational axis 210 is connected with the other end of the arm 209. Thus, when the one end of the arm 209 is turned upward around the rotational axis 210 as a fulcrum, the upper roller 208*a* is moved upward, whereby the upper roller 208*a* can be separated from the lower roller 208*b*. On the other hand, when the one end of the arm 209 is turned downward around the rotational axis 210, the upper roller 208*a* is moved downward, whereby the upper roller 208*a* can be brought close to the lower roller 208*b*.

When a paper sheet P is to be stacked on the processing tray 205, the upper roller 208*a* is separated from the lower roller 208*b*, and the leading end of the paper sheet P is caused to enter between the upper roller 208*a* and the lower roller 208*b*. Thereafter, the paper sheet P is moved obliquely downward along the placement surface of the processing tray 205 by, for example, a paddle (not shown) (or the paper sheet P is moved obliquely downward along the placement surface of the processing tray 205 by self-weight). The staple unit U2 is located at the other end of the processing tray 205, and performs stapling processing for a sheet bundle stacked on the processing tray 205.

When the sheet bundle processed by stapling processing is to be discharged to the sheet discharge tray 204, the upper roller 208*a* is brought close to the lower roller 208*b*, whereby the sheet bundle is held between the upper roller 208*a* and the lower roller 208*b*. Then, the upper roller 208*a* and the lower roller 208*b* are rotated, whereby the sheet bundle processed by stapling processing is discharged to the sheet discharge tray 204 via a discharge port 211.

Guides 205*a* that can be moved in the width direction of a paper sheet P (direction perpendicular to the conveyance direction) are provided on the processing tray 205. The guides 205*a* thus provided on the processing tray 205 enable a sheet bundle stacked on the processing tray 205 to be shifted in the width direction of a paper sheet P. That is, a sheet bundle to be discharged to the sheet discharge tray 204 is shifted in the width direction of a paper sheet P, whereby sheet bundles can be sorted.

When folding processing is performed, the switching claw 207*a* is turned in a direction to close the entrance port of the conveyance path 20*a* and the switching claw 207*b* is turned in a direction to close the entrance port of the conveyance path 20*b* while the switching claw 207*c* is turned in a direction to open an entrance port of the conveyance path 20*c*. Thus, a paper sheet P enters the conveyance path 20*c*, to be guided to the booklet unit U3.

(Automatic Mode and Manual Mode in Stapling Processing)

The post-processing apparatus 200 can be switched between an automatic mode and a manual mode in stapling processing. For example, at start of the image forming apparatus 100 (post-processing apparatus 200), the processing mode for the stapling processing is set at the automatic mode. In the state of the automatic mode, when a mode switching operation is performed, the automatic mode is switched to the manual mode.

In the automatic mode, the image forming apparatus 100 (printing portion 107) executes a print job and feeds a printed paper sheet P to the post-processing apparatus 200. Then, the staple unit U2 executes stapling processing for the paper sheets P (a sheet bundle composed of a plurality of stacked paper sheets P) conveyed to the processing tray 205 by the conveying roller pairs 202.

On the other hand, in the manual mode, the staple unit U2 executes stapling processing for paper sheets P stacked on the processing tray 205 by a user in response to an execution instruction from the user. A user can perform a switching instruction from the automatic mode to the manual mode or an execution instruction of stapling processing, by performing an operation on a mode switching operation portion 220 (see FIG. 3) provided on the post-processing apparatus 200. It is noted that the configuration of the mode switching operation portion 220 will be described later in detail.

When the processing mode for the stapling processing is switched from the automatic mode to the manual mode, the upper roller 208*a* is moved in a direction (upward) to be separated from the lower roller 208*b*, whereby a gap occurs between the upper roller 208*a* and the lower roller 208*b*. This enables a sheet bundle to be inserted from the discharge port 211 so that the sheet bundle is stacked on the processing tray 205.

(Configuration of Mode Switching Operation Portion)

On the apparatus front surface side of the post-processing apparatus 200, the mode switching operation portion 220 is provided (see FIG. 1) for receiving from a user an operation to switch the processing mode for stapling processing including the automatic mode and the manual mode. It is noted that the mode switching operation portion 220 corresponds to an "operation portion" of the present disclosure.

In light of operability for a user, such a mode switching operation portion 220 may be exposed out of the housing of the post-processing apparatus 200. However, in the case where the mode switching operation portion 220 is exposed out of the housing of the post-processing apparatus 200, a user may touch the mode switching operation portion 220 unintentionally, so that the processing mode for stapling processing may be switched from the automatic mode to the manual mode. When the processing mode for stapling processing has been thus switched to the manual mode by a user touching the mode switching operation portion 220 unintentionally, the user who has touched the mode switching operation portion 220 may not recognize that the processing mode for stapling processing has been switched to the manual mode. Therefore, the processing mode for stapling processing is not switched to the automatic mode and is left to be the manual mode (a job in the automatic mode is left in the unexecuted state). In this case, a user who desires to execute a job in the automatic mode needs to perform a switching operation to the automatic mode. As a result, convenience for a user is reduced. In contrast, as described below, the post-processing apparatus 200 according to the embodiment of the present disclosure prevents unintentional switching of the processing mode for stapling processing, thereby improving convenience for a user.

Figure 3:
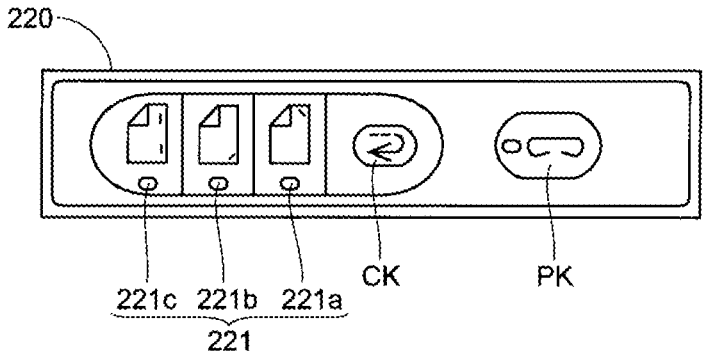
FIG. 3 is a diagram of an operation portion provided on the post-processing apparatus shown in FIG. 1.

As shown in FIG. 3, the mode switching operation portion 220 includes a switching key CK for receiving switching between the automatic mode and the manual mode, and an execution key PK for receiving an execution instruction of stapling processing in the manual mode. In addition, the mode switching operation portion 220 is provided with a plurality of indication lamps 221 (221*a*, 221*b*, and 221*c*) which indicate the present setting related to the staple position in the manual mode.

The indication lamp 221 is turned on when the automatic mode is switched to the manual mode and turned off when the manual mode is switched to the automatic mode. Specifically, in the automatic mode, all the indication lamps 221*a* to 221*c* are turned off. Thus, a user recognizes that the present processing mode is the automatic mode. When the switching key CK is pressed in the automatic mode, the automatic mode is switched to the manual mode, and one of the plurality of indication lamps 221 is turned on. Thus, a user recognizes that the automatic mode has been switched to the manual mode.

For example, when the switching key CK is pressed in the automatic mode, the automatic mode is switched to the manual mode and the indication lamp 221*a* is turned on first. Then, when the switching key CK is repeatedly pressed, the indication lamp 221 to be turned on is changed in order, the indication lamp 221*a*→the indication lamp 221*b*→the indication lamp 221*c*. That is, the setting of the staple position in the manual mode is sequentially changed. Then, if the switching key CK is pressed when the indication lamp 221*c* is on, the manual mode is switched to the automatic mode and all the indication lamps 221*a* to 221*c* are turned off.

Figure 4:
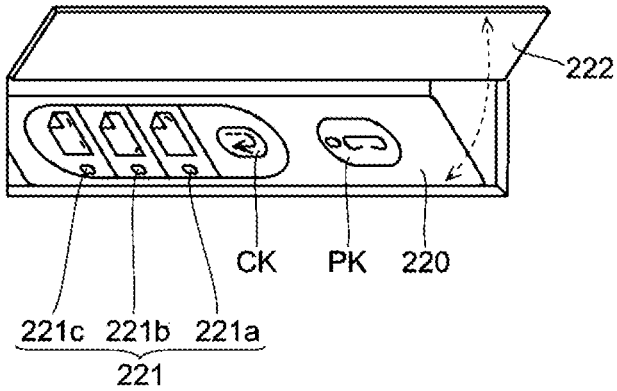
FIG. 4 is a diagram showing a cover attached in an openable and closable manner on the operation portion of the post-processing apparatus shown in FIG. 1.

As shown in FIG. 4, a cover 222 is attached in an openable and closable manner at a portion where the mode switching operation portion 220 is provided. The cover 222, when closed, covers the mode switching operation portion 220. On the other hand, the cover 222, when opened, exposes the mode switching operation portion 220, so that the mode switching operation portion 220 can be operated.

(Hardware Configuration of Image Forming Apparatus Provided with Post-Processing Apparatus)

Figure 5:
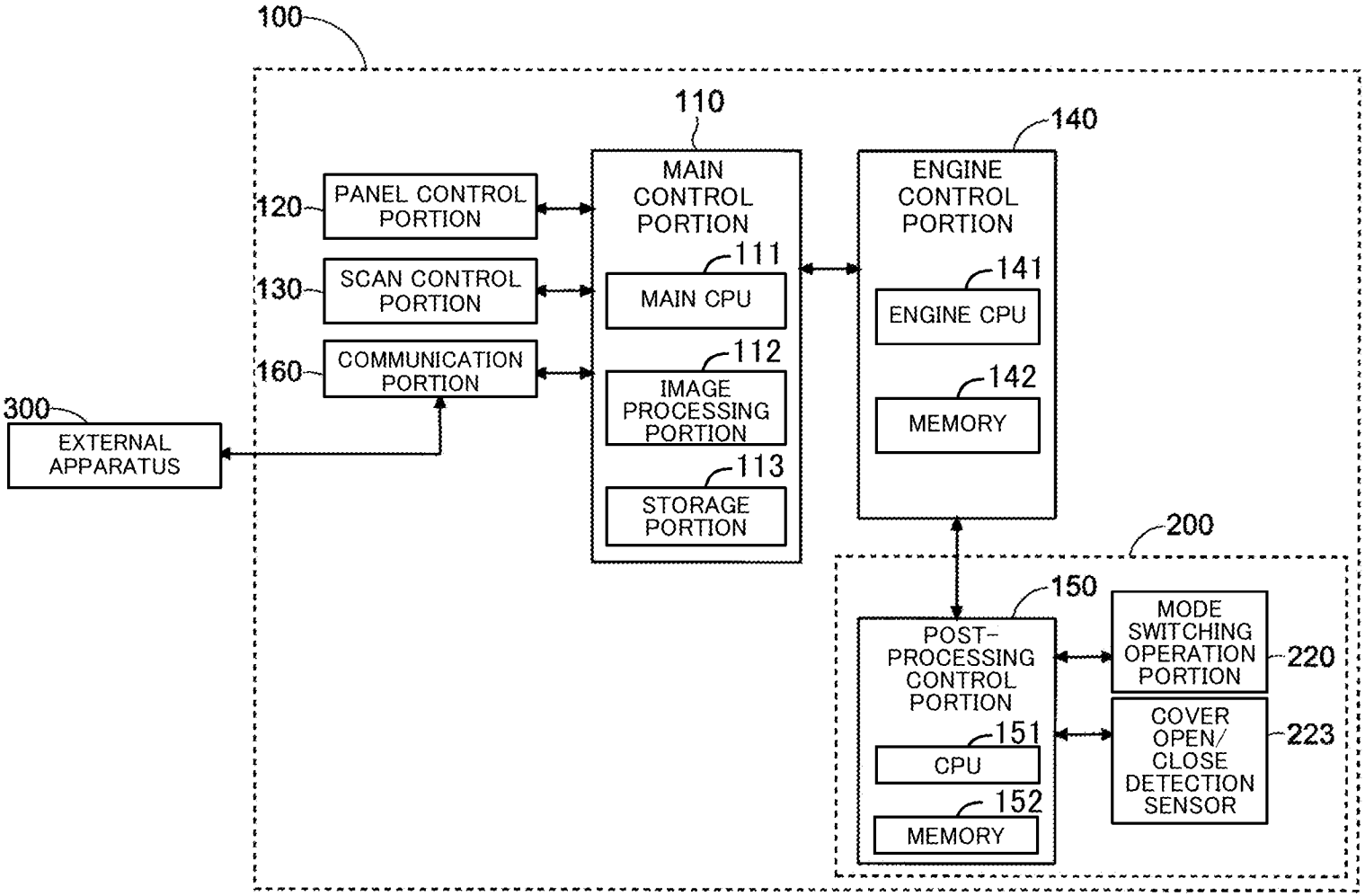
FIG. 5 is a block diagram showing the hardware configuration of the image forming apparatus provided with the post-processing apparatus shown in FIG. 1.

As shown in FIG. 5, the image forming apparatus 100 includes a main control portion 110 which performs overall control of the apparatus. The main control portion 110 includes a main CPU 111, an image processing portion 112, and a storage portion 113. The image processing portion 112 is composed of an ASIC dedicated for image processing, etc., and performs various types of image processing (expansion/reduction, density conversion, data form conversion, etc.) for image data. The storage portion 113 includes a ROM, a RAM, and the like. For example, a program and data needed for execution of a job is stored in the ROM, and such a program and data are developed on the RAM.

A panel control portion 120 and a scan control portion 130 are connected to the main control portion 110. The panel control portion 120 includes a CPU and a memory (not shown), and controls the display operation of the operation panel 101 by receiving an instruction from the main control portion 110. The scan control portion 130 includes a CPU and a memory (not shown), and controls the document sheet conveying operation of the document sheet conveying portion 102A and/or the scan operation of the image reading portion 102B by receiving an instruction from the main control portion 110.

An engine control portion 140 is connected to the main control portion 110. The engine control portion 140 includes an engine CPU 141 and a memory 142, and controls a printing operation of the printing portion 107 (the sheet feed portion 103, the paper sheet conveyance portion 104, the image forming portion 105, and the fixing portion 106) by receiving an instruction from the main control portion 110.

A post-processing control portion 150 is connected to the engine control portion 140. The post-processing control portion 150 includes a CPU 151 and a memory 152. The post-processing control portion 150 controls the post-processing operation executed by the post-processing apparatus 200 by receiving an instruction from the main control portion 110 via the engine control portion 140.

The post-processing control portion 150 is connected to the mode switching operation portion 220. The post-processing control portion 150 switches the processing mode for stapling processing including the automatic mode and the manual mode in response to an operation on the mode switching operation portion 220. That is, the post-processing control portion 150 corresponds to a "mode switching portion" of the present disclosure.

The post-processing control portion 150 is connected to a cover open/close detection sensor 223 capable of detecting whether the cover 222 (cover for covering the mode switching operation portion 220) is opened or closed. The cover open/close detection sensor 223 changes its output depending on whether the cover 222 is opened or closed. Thus, based on the output of the cover open/close detection sensor 223, whether the cover 222 is opened or closed can be detected. The output of the cover open/close detection sensor 223 is received by the post-processing control portion 150, and the post-processing control portion 150 detects whether the cover 222 is opened or closed. That is, the post-processing control portion 150 connected to the cover open/close detection sensor 223 corresponds to an "open/close detection portion" of the present disclosure.

A communication portion 160 is also connected to the main control portion 110. The communication portion 160 is connected to an external apparatus 300 via a network, and communicates with the external apparatus 300 by receiving an instruction from the main control portion 110. Thus, printing can be performed based on image data transmitted from the external apparatus 300. In addition, it is also possible to transmit image data to the external apparatus 300. The external apparatus 300 is, for example, a user terminal, a server, a facsimile apparatus, etc.

(Switching of Processing Mode for Stapling Processing)

In the present embodiment, since the mode switching operation portion 220 is covered by the cover 222, an operation on the mode switching operation portion 220 cannot be performed unless the cover 222 is opened. Therefore, when a user is to switch the processing mode for stapling processing from the automatic mode to the manual mode, the user opens the cover 222 first.

At this time, the post-processing control portion 150 detects that the cover 222 has been opened, based on the output of the cover open/close detection sensor 223. Then, while the post-processing control portion 150 is detecting that the cover 222 has been opened, when the mode switching operation portion 220 has received an operation for switching to the manual mode, the post-processing control portion 150 transmits a switching request from the automatic mode to the manual mode, to the main control portion 110. Then, the post-processing control portion 150 receives an instruction from the main control portion 110 and switches the automatic mode to the manual mode.

It is noted that after the main control portion 110 has instructed the post-processing control portion 150 to switch the automatic mode to the manual mode, the main control portion 110 prohibits execution of a print job (a printed paper sheet P is not fed to the post-processing apparatus 200) until the main control portion 110 receives a switching request from the manual mode to the automatic mode from the post-processing control portion 150. Therefore, in the manual mode, a print job cannot be executed in the image forming apparatus 100.

In addition, after the post-processing control portion 150 has switched the processing mode to the manual mode, when the post-processing control portion 150 has detected that the cover 222 has been closed, the post-processing control portion 150 transmits a switching request from the manual mode to the automatic mode to the main control portion 110 even if the mode switching operation portion 220 has not received an operation for switching to the automatic mode. Then, the post-processing control portion 150 receives an instruction from the main control portion 110 and switches the manual mode to the automatic mode. At this time, since the manual mode has been switched to the automatic mode, a print job can be executed in the image forming apparatus 100.

In addition, after the post-processing control portion 150 has switched the processing mode to the manual mode, when the mode switching operation portion 220 has received an operation for switching to the automatic mode, the post-processing control portion 150 transmits a switching request from the manual mode to the automatic mode to the main control portion 110 even if the post-processing control portion 150 has not detected that the cover 222 has been closed. Then, the post-processing control portion 150 receives an instruction from the main control portion 110 and switches the manual mode to the automatic mode.

Hereinafter, with reference to a flowchart in FIG. 6, an operation performed when the processing mode for stapling processing is switched from the automatic mode to the manual mode will be described.

Figure 6:
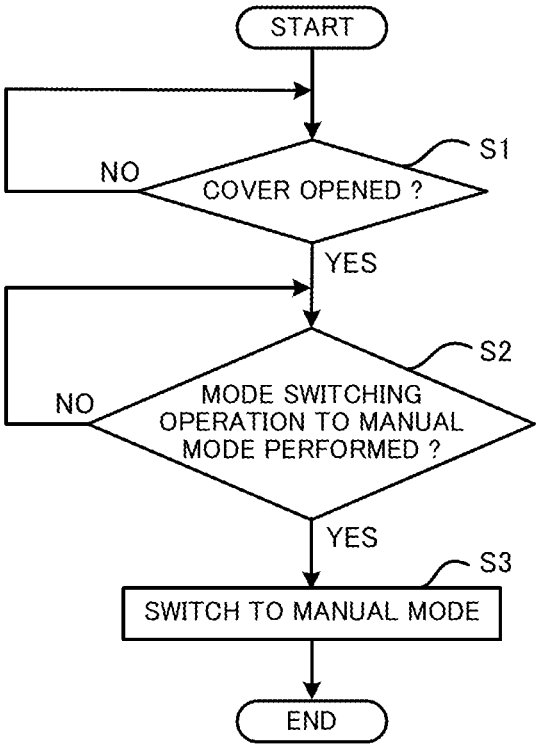
FIG. 6 is a flowchart for explaining an operation performed when the processing mode for stapling processing is switched to a manual mode in the post-processing apparatus shown in FIG. 1.

First, "START" in the flowchart in FIG. 6 indicates the start of the image forming apparatus 100 (post-processing apparatus 200). It is noted that at the start, the processing mode for stapling processing is set at the automatic mode (the cover 222 is closed).

In step S1, the post-processing control portion 150 detects whether the cover 222 is opened or closed, based on the output of the cover open/close detection sensor 223, to determine whether or not the cover 222 has been opened. As a result, if the cover 222 has been opened, the process shifts to step S2. On the other hand, if the cover 222 has not been opened (the cover 222 is closed), the processing mode for stapling processing is not switched and is kept in the automatic mode, and the determination of step S1 is repeated.

In step S2, the post-processing control portion 150 determines whether or not the mode switching operation portion 220 has received a mode switching operation for switching to the manual mode. As a result, if the mode switching operation portion 220 has received the mode switching operation, the process shifts to step S3. On the other hand, if the mode switching operation portion 220 has not received the mode switching operation, the processing mode for stapling processing is not switched and is kept in the automatic mode, and the determination of step S2 is repeated.

In step S3, the post-processing control portion 150 switches the processing mode for stapling processing from the automatic mode to the manual mode.

Next, with reference to a flowchart in FIG. 7, an operation performed when the processing mode for stapling processing is switched from the manual mode to the automatic mode will be described.

Figure 7:
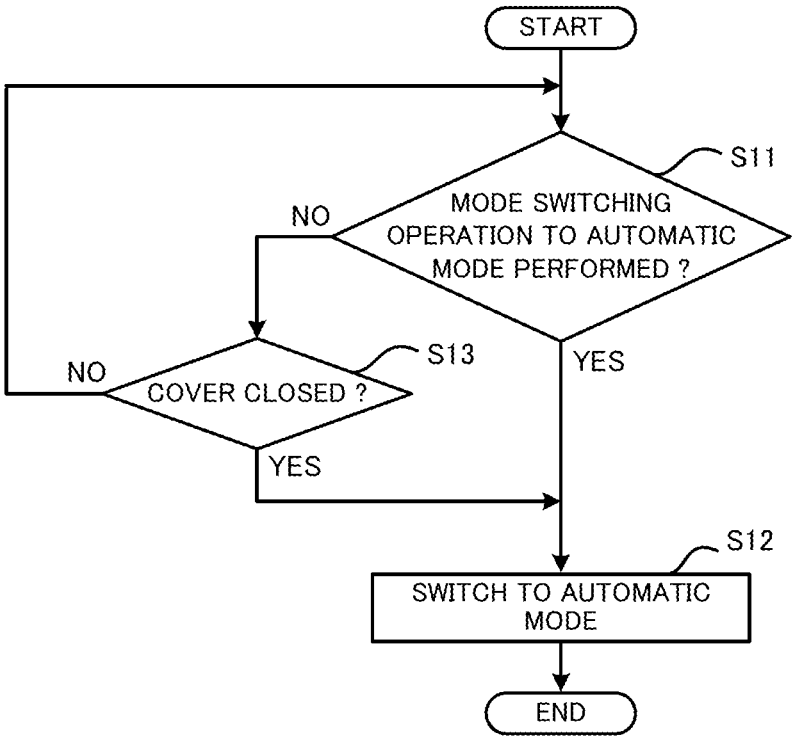
FIG. 7 is a flowchart for explaining an operation performed when the processing mode for stapling processing is switched to an automatic mode in the post-processing apparatus shown in FIG. 1.

First, "START" in the flowchart in FIG. 7 indicates a time when the processing mode for stapling processing has been switched from the automatic mode to the manual mode. That is, at the start, the processing mode for stapling processing is set at the manual mode (the cover 222 is opened).

In step S11, the post-processing control portion 150 determines whether or not the mode switching operation portion 220 has received a mode switching operation for switching to the automatic mode. As a result, if the mode switching operation portion 220 has received the mode switching operation, the process shifts to step S12. On the other hand, if the mode switching operation portion 220 has not received the mode switching operation, the process shifts to step S13.

In step S12, the post-processing control portion 150 switches the processing mode for stapling processing from the manual mode to the automatic mode.

In step S13, the post-processing control portion 150 detects whether the cover 222 is opened or closed, based on the output of the cover open/close detection sensor 223, to determine whether or not the cover 222 has been closed. As a result, if the cover 222 has been closed, the process shifts to step S12 to switch the processing mode for stapling processing from the manual mode to the automatic mode. On the other hand, if the cover 222 has not been closed (the cover 222 is opened), the processing mode for stapling processing is not switched and is kept in the manual mode, and the process returns to step S11.

As described above, the post-processing apparatus 200 of the present embodiment includes the processing tray 205 for stacking thereon a paper sheet P to be processed by stapling processing, the conveying roller pair 202 (conveyance portion) that conveys a paper sheet P to the processing tray 205, the staple unit U2 that, in the automatic mode, executes stapling processing for the paper sheet P conveyed to the processing tray 205 by the conveying roller pair 202, and in the manual mode, executes stapling processing for a paper sheet P stacked on the processing tray 205 by a user, the mode switching operation portion 220 (operation portion) that receives an operation for switching between the automatic mode and the manual mode, the cover 222 attached in an openable and closable manner so as to cover the mode switching operation portion 220 when the cover 222 is closed and expose the mode switching operation portion 220 when the cover 222 is opened, and the post-processing control portion 150 (open/close detection portion, mode switching portion) that detects whether the cover 222 is opened or closed, and performs switching between the automatic mode and the manual mode in response to an operation on the mode switching operation portion 220. While the post-processing control portion 150 is detecting that the cover 222 is opened, when the mode switching operation portion 220 has received an operation for switching to the manual mode, the post-processing control portion 150 switches the processing mode for stapling processing from the automatic mode to the manual mode.

According to the configuration of the present embodiment, while the post-processing control portion 150 is detecting that the cover 222 is opened, when the mode switching operation portion 220 has received an operation for switching to the manual mode, the post-processing control portion 150 switches the automatic mode to the manual mode. That is, in order to switch the processing mode for stapling processing from the automatic mode to the manual mode, a user needs to open the cover 222 first and perform an operation for switching to the manual mode on the mode switching operation portion 220 while the cover 222 is opened (the mode switching operation portion 220 is exposed). Therefore, occurrence of trouble can be prevented in which a user unintentionally touches the mode switching operation portion 220 and thereby the processing mode for stapling processing is switched to the manual mode. As a result, the processing mode for stapling processing can be prevented from being left to be the manual mode (a job in the automatic mode is left in the unexecuted state), whereby convenience for a user is improved.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A post-processing apparatus comprising:

a processing tray configured to stack thereon a paper sheet to be processed by stapling processing;

a conveyance portion configured to convey the paper sheet to the processing tray;

a staple unit having an automatic mode and a manual mode as processing modes for the stapling processing, the staple unit being configured to, in the automatic mode, execute the stapling processing for a paper sheet conveyed to the processing tray by the conveyance portion, and in the manual mode, execute the stapling processing for a paper sheet stacked on the processing tray by a user;

an operation portion configured to receive an operation for switching between the automatic mode and the manual mode;

a mode switching portion configured to perform switching between the automatic mode and the manual mode in response to an operation on the operation portion;

a cover attached in an openable and closable manner so as to cover the operation portion when the cover is closed and expose the operation portion when the cover is opened; and an open/close detection portion configured to detect whether the cover is opened or closed, wherein while the open/close detection portion is detecting that the cover is opened, when the operation portion has received an operation for switching to the manual mode, the mode switching portion switches the automatic mode to the manual mode.

2. The post-processing apparatus according to claim 1, wherein after the mode switching portion has performed switching to the manual mode, when the open/close detection portion has detected that the cover has been closed, the mode switching portion switches the manual mode to the automatic mode even if the operation portion has not received an operation for switching to the automatic mode.

3. The post-processing apparatus according to claim 2, wherein after the mode switching portion has performed switching to the manual mode, when the operation portion has received an operation for switching to the automatic mode, the mode switching portion switches the manual mode to the automatic mode even if the open/close detection portion has not detected that the cover has been closed.

4. The post-processing apparatus according to claim 1, wherein after the mode switching portion has performed switching to the manual mode, when the operation portion has received an operation for switching to the automatic mode, the mode switching portion switches the manual mode to the automatic mode even if the open/close detection portion has not detected that the cover has been closed.

5. An image forming apparatus comprising: a post-processing apparatus; and a printing portion configured to execute a print job and to feed a printed paper sheet to the post-processing apparatus, wherein the post-processing apparatus includes:

a processing tray configured to stack thereon a paper sheet to be processed by stapling processing;

a conveyance portion configured to convey the paper sheet to the processing tray;

a staple unit having an automatic mode and a manual mode as processing modes for the stapling processing, the staple unit being configured to, in the automatic mode, execute the stapling processing for a paper sheet conveyed to the processing tray by the conveyance portion, and in the manual mode, execute the stapling processing for a paper sheet stacked on the processing tray by a user;

an operation portion configured to receive an operation for switching between the automatic mode and the manual mode;

a mode switching portion configured to perform switching between the automatic mode and the manual mode in response to an operation on the operation portion;

a cover attached in an openable and closable manner so as to cover the operation portion when the cover is closed and expose the operation portion when the cover is opened; and an open/close detection portion configured to detect whether the cover is opened or closed, wherein while the open/close detection portion is detecting that the cover is opened, when the operation portion has received an operation for switching to the manual mode, the mode switching portion switches the automatic mode to the manual mode.

6. The image forming apparatus according to claim 5, wherein after the mode switching portion has performed switching to the manual mode, when the open/close detection portion has detected that the cover has been closed, the mode switching portion switches the manual mode to the automatic mode even if the operation portion has not received an operation for switching to the automatic mode.

7. The image forming apparatus according to claim 6, wherein after the mode switching portion has performed switching to the manual mode, when the operation portion has received an operation for switching to the automatic mode, the mode switching portion switches the manual mode to the automatic mode even if the open/close detection portion has not detected that the cover has been closed.

8. The image forming apparatus according to claim 5, wherein after the mode switching portion has performed switching to the manual mode, when the operation portion has received an operation for switching to the automatic mode, the mode switching portion switches the manual mode to the automatic mode even if the open/close detection portion has not detected that the cover has been closed.

* * * * *